United States Patent [19]

Kemeny et al.

[11] 4,347,463

[45] Aug. 31, 1982

[54] ELECTROMAGNETIC PROJECTILE LAUNCHER WITH SELF-AUGMENTING RAILS

[75] Inventors: George A. Kemeny, Wilkins Township, Allegheny County; Donald C. Litz, Murrysville Boro, both of Pa.

[73] Assignee: Westinghouse Electric Corp., Pittsburgh, Pa.

[21] Appl. No.: 137,059

[22] Filed: Apr. 3, 1980

[51] Int. Cl.[3] ..... H02K 41/00

[52] U.S. Cl. ..... 318/135; 310/13; 124/3

[58] Field of Search ..... 310/10, 11, 12–14; 124/3; 318/135

[56] References Cited

U.S. PATENT DOCUMENTS

| | | | |
|---|---|---|---|
| 1,370,200 | 3/1921 | Fauchon-Villepleé et al. | 310/13 |
| 1,422,427 | 7/1922 | Fauchon-Villepleé et al. | 124/3 |
| 2,214,297 | 9/1940 | Ferry | 124/3 |
| 2,870,675 | 1/1959 | Salisbury | 124/3 X |
| 3,337,760 | 8/1967 | Allport | 310/13 |
| 3,579,001 | 5/1971 | Pelenc | 310/13 |

*Primary Examiner*—Donovan F. Duggan
*Attorney, Agent, or Firm*—F. J. Baehr, Jr.

[57] ABSTRACT

A self-augmented parallel rail electromagnetic projectile launcher with a commutating circuit breaker disposed adjacent the breech.

23 Claims, 3 Drawing Figures

ELECTROMAGNETIC PROJECTILE LAUNCHER WITH SELF-AUGMENTING RAILS

CROSS-REFERENCE TO RELATED APPLICATIONS

A patent application by one of the co-inventors entitled "A Switching System for High DC Current" filed Dec. 7, 1979 and assigned Ser. No. 100,302 provides a general background to electromagnetic projectile launchers, and is hereby incorporated by reference.

BACKGROUND OF THE INVENTION

This invention relates to electromagnetic projectile launchers and more particularly to such launchers with conductors parallel to the rails for augmenting the field. To reach the present goals of velocity and payload mass utilizing a single pair of parallel rails requires, for a particular high velocity application, ultra-high currents in the range of 1.5 million amperes. By placing conductors, which conduct current in the same direction as the rails, adjacent the rails the energy transferred to the projectile can be maintained while reducing the current supplied via the conductors and rails.

SUMMARY OF THE INVENTION

In general an electromagnetic projectile launcher, when made in accordance with this invention, comprises a first conductor, a second conductor disposed generally parallel the first conductor and means for propelling the projectile from one end of the first and second conductors to the other end thereof and for conducting current therebetween. The launcher also comprises a third conductor disposed generally parallel and adjacent the second conductor and being electrically connected to the first conductor adjacent the one end thereof and a fourth conductor disposed generally parallel and adjacent the first conductor and electrically connected to the second conductor adjacent the one end thereof. The launcher also comprises a source of high DC current electrically connected to the other end of the third and fourth conductors and circuit breaking means electrically connected between the one end of the first and second conductors whereby current required for propelling a projectile to launch velocity is lower than required utilizing a single pair of conductors.

BRIEF DESCRIPTION OF THE DRAWINGS

The objects and advantages of this invention will become more apparent from reading the following detailed description in conjunction with the following drawings in which.

DESCRIPTION OF THE PREFERRED EMBODIMENT

Figure 1:
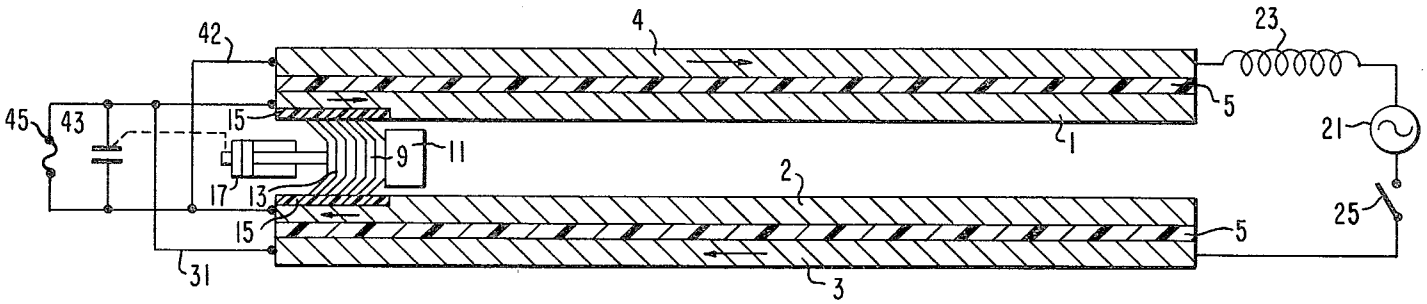
FIG. 1 is a schematic diagram of an electromagnetic projectile launching system having self-augmented parallel rails.

Referring now to the drawings in detail and in particular to FIG. 1, there is shown an electromagnetic projectile launcher comprising a first conductive rail or conductor 1, a second conductive rail or conductor 2 disposed generally parallel the first conductor 1, a third conductor 3 disposed generally parallel and adjacent the second conductor 2 and electrically connected to one end of the first conductor 1, and a fourth conductor 4 disposed generally parallel to the first conductor 1 and adjacent thereto and electrically connected to one end of the second conductor 2. The first and fourth conductors 1 and 4, respectively, are electrically insulated from each other by an insulating strip 5 or other electrical insulating means and the second and third conductors 2 and 3, respectively, are electrically insulated in a similar manner by the insulation strip 5.

An armature 9 is slidably disposed between the first and second conductive rails 1 and 2 and a projectile 11 is disposed on the armature, which is to be accelerated from one end of the first and second rails to the other, that is, from the breech to the muzzle or from the left to right as shown in FIG. 1. Preferably the armature 9 is formed from a plurality of copper sheets 13, which have margins that contact the conductive rails 1 and 2 and are bent away from the direction of travel. The bent margins provide good electrical contact as the armature 9 and projectile 11 traverse the first and second conductive rails from one end to the other. While a copper armature may be preferred, it is understood that other types of armatures could be utilized to propel the projectile and conduct current between the conductive rails 1 and 2 including one made integral with the projectile or an arc.

The conductive rails 1 and 2 each have an insulating strip 15 disposed adjacent the one end thereof, the end on the left as shown in FIG. 1, to electrically isolate the armature 9 from the conductors 1 and 2 when it is adjacent the one end or in the breech. A pneumatic, hydraulic, explosive, electromagnetic or mechanical means 17 is disposed adjacent the one end or breech end of the rails 1 and 2 for initiating movement of the armature 9 and to move it to a conductive portion of the conductive rails 1 and 2.

A source of high DC current is shown adjacent the other end or muzzle end of the conductive rails 1 and 2 as shown in FIG. 1, the right end, and comprises a homopolar generator 21 or other current producing means, an induction coil 23 and a make switch 25 or other switching means connected in series. One lead from the source is connected to the third conductor 3 adjacent the other end thereof and the other lead from the source is electrically connected to the fourth conductor 4 adjacent the other end thereof. A lead 31 or short bus connects the third conductor 3 to the first conductor 1 adjacent the one end thereof, and a lead 42 or short bus connects the fourth conductor 4 to the second conductor 2 adjacent the one end thereof. Circuit breaking means 43, which may include a parallel connected fuse 45, or other circuit breaking means capable of interrupting very high currents which may reach 1 to 1.5. million amps are connected across the one end of the first and second conductors 1 and 2. The circuit breaking means 43 is synchronized with the means for initiating movement of the armature 17 so that they operate in conjunction.

Figure 2:
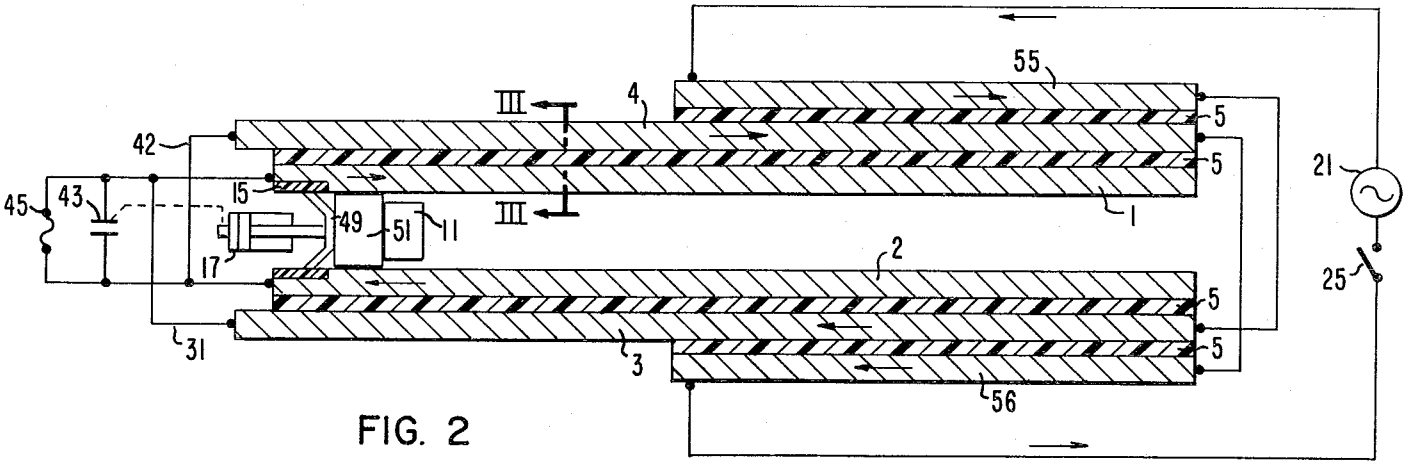
FIG. 2 is a schematic diagram of an alternative embodiment.

FIG. 2 shows a schematic diagram of a projectile launcher having the first and second rails 1 and 2 disposed parallel to each other with means 47 for establishing an arc and for propelling the projectile 11 from one end of the rails 1 and 2 to the other. The means 47 for establishing an arc and for propelling the projectile comprises a shooting wire or fuse 49, which initiates the current flow between the rails 1 and 2, disintegrates and thereby forms an ionized plasma or arc through which current continues to flow between the rails 1 and 2, and an insulating ablative sabot 51, which is disposed between the shooting wire 49 or arc and the projectile 11 to move the projectile ahead of the arc and propel it from one end of the rails 1 and 2 to the other. The means 17 for initiating movement of the shooting wire 49 and projectile 11 moves the shooting wire 49 beyond the insulators 15 in contact with the rails 1 and 2 to initiate conduction and subsequently the arcing.

Besides the first and second rails or conductors 1 and 2 there are disposed additional conductors 3 and 4 and 55 and 56, which are disposed parallel to each other in two groups. The conductors are insulated from each other by insulating strips 5 or other means and are electrically connected so that current flows in one direction in one group and in another direction in the other group as shown in FIG. 2. Two or even more of the conductors may not be coextensive with the length of the projectile track or barrel, which incorporates the first and second rails 1 and 2.

The current supply may comprise the homopolar generator 21 or other generating means and the inductive storage of energy may be in the rail or conductor circuitry either greatly reducing the size or energy storage capability of the required inductance coil or completely eliminating the inductance coil 23 as utilized in FIG. 1.

The circuit breaking means 43 is disposed to provide a high current flow path or short adjacent one end or the breech of the first and second rails 1 and 2 so that current flows through all the rails except the first and second rail as the system is being energized, thus storing inductive energy in the parallel augmenting rails or conductors rather than in an induction coil or in the augmenting rails and in an additional induction coil (not shown). The electrical positioning of the circuit breaking means 43 is critical in that it must be connected electrically across the breech of the first and second rails 1 and 2 and physically close to the breech to simplify the rapid commutation of current to the first and second rails 1 and 2 to initiate launching of the projectile.

Figure 3:
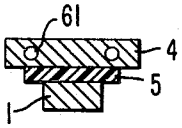
FIG. 3 is a sectional view taken in line III—III of FIG. 2.

It should be understood that the augmenting conductors must also conduct current during the relatively long period, while the current builds up to its maximum or desired level. The launching conductive rails 1 and 2 on the other hand need only conduct current during the far shorter launching and post launching current decay period. Therefore, the augmenting rails will have to be designed so as not to overheat. This may be accomplished by increasing their cross-section, pre-cooling before a launch making them of very low resistivity material and/or additionally providing cooling means to provide cooling between shots, for example, ducts 61 for fluid cooling as shown in FIG. 3.

It should also be understood that current will decay during launching and that therefore the current induced force, which propels the projectile 11 also decreases as the projectile 11 passes from the breech to the muzzle. The magnetic flux augmenting conductors may therefore be deliberately arranged in a suitable geometry with respect to each other so that, as the projectile passes from the breech to the muzzle and the current decreases, the magnetic flux level increases in order that force on the projectile remains substantially constant or near to maximum allowable level. The net effect of constant force at its maximum allowable level is constant acceleration at the maximum level and therefore the shortest barrel for attaining the desired exit velocity.

The operation of the electromagnetic projectile launcher described hereinbefore and as shown in FIG. 1 is as follows.

Kinetic energy produced by a prime mover (not shown) is converted to electrical energy by the homopolar generator 21 in the form of high DC current, which builds up to a predetermined level, which may be in the neighborhood of 1 to 1.5 million amps as it flows in series through the closed make switch 25, the third conductor 3, the lead 31, the parallel-connected circuit breaker 43 and fuse 45, the lead 42, the fourth conductor 4, and the induction coil 23. The conductors 3 and 4 have a geometry, which produces an inductance of approximately 0.5 microhenries per meter so that at the high currents involved between 1 and 1.5 million amps, a substantial amount of energy is inductively stored within the third and fourth conductor geometry as well as in the induction coil 23. When the predetermined current level is attained, the circuit breaker means 43 is opened and the means for initiating movement 17 of the armature 9 is activated moving the armature 9 to conductive portions of the first and second rails 1 and 2 commutating current to the conductive rails 1 and 2 and to the armature 9 causing the armature 9 to accelerate from one end of the first and second conductors to the other, from the breech to the muzzle, or from left to right as shown in FIG. 1. It should be noted that during launching, current flows in the same direction in the augmenting conductors as in the adjacent conductive rails, that is, in the same direction in conductors 1 and 4 and in the same direction in conductors 2 and 3.

The operation of the projectile launcher shown in FIGS. 2 and 3 is similar to that shown in FIG. 1, the difference being the inductive energy is stored in the conductor geometry represented by conductors 3, 4, 55, and 56, and of course in any additional buswork required to conduct current, rather than in the induction coil 23 and an arc rather an armature is utilized to propel the projectile 11.

The electromagnetic projectile launcher hereinbefore described advantageously results in lower currents, while maintaining the same energy transfer to the projectile than non-augmented arrangements; a substantial reduction of heating of the launching rails compared to a non-augmented arrangement developing the same velocity, the utilization of lighter armatures due to the lower currents, which result in higher payloads and also allows smaller induction coils and homopolar machines having less brushes, and, therefore, more efficiency in converting the originally stored kinetic energy to kinetic energy of the projectile.

We claim:

1. An electromagnetic projectile launcher comprising:

a first conductor;

a second conductor disposed generally parallel to said first conductor;

means for propelling a projectile from one end of the first and second conductors to the other end thereof and for conducting current therebetween;

a third conductor disposed generally parallel and adjacent said second conductor and being electrically connected to said first conductor adjacent said one end thereof;

a fourth conductor disposed generally parallel and adjacent said first conductor and being electrically connected to said second conductor adjacent said one end thereof;

a source of high current electrically connected to the other end of said third and fourth conductors; and circuit breaking means electrically connected between the one end of said first and second conductors, whereby the current required for launching a projectile at a predetermined velocity is rapidly commutated to the first and second conductors by opening said circuit breaking means and the current is lower than that required utilizing a single pair of conductors.

2. An electromagnetic projectile launcher as set forth in claim 1, wherein the means for propelling the projectile is a conductive armature slidably disposed between the first and second conductors.

3. An electromagnetic projectile launcher as set forth in claim 1, wherein the circuit breaking means comprises a high current switch connected in parallel with a fuse.

4. An electromagnetic projectile launcher as set forth in claim 1, wherein there is electrical insulation disposed between the first and fourth conductors and between the second and third conductors.

5. An electromagnetic projectile launcher as set forth in claim 2, wherein the first and second conductors have an insulating strip disposed adjacent the one end thereof between at least one of the conductors and the armature.

6. An electromagnetic projectile launcher as set forth in claim 5, and further comprising means for initiating movement of the conductive armature to move it beyond the insulating strips.

7. An electromagnetic projectile launcher as set forth in claim 1, wherein the source of high current comprises an induction coil.

8. An electromagnetic projectile launcher as set forth in claim 7, wherein the source of high current further comprises a homopolar generator.

9. An electromagnetic projectile launcher as set forth in claim 1, and further comprising series switching means disposed between the source and one conductor.

10. An electromagnetic projectile launcher as set forth in claim 1, wherein the current in the first and fourth conductors flows in the same direction and the current in the second and third conductors flows in the same direction.

11. An electromagnetic projectile launcher comprising:

a first conductor;

a second conductor disposed generally parallel to said first conductor;

means for propelling a projectile from one end of the first and second conductors to the other and for conducting current therebetween;

additional conductors disposed in groups adjacent said first and second conductors;

said additional conductors being so disposed that conductors disposed adjacent said first conductor have current that flows in the same direction as it flows in the first conductor and conductors disposed adjacent said second have current that flows in the same direction as it flows in the second conductor;

a source of high current electrically connected to said conductors; and circuit breaking means electrically connected to the one end of said first and second conductors, whereby the current required for launching the projectile at a predetermined velocity is rapidly commutated to the first and second rails and is at a lower value than required utilizing a single pair of conductors.

12. An electromagnetic projectile launcher as set forth in claim 11, wherein all of said conductors are connected in series during the launch.

13. An electromagnetic projectile launcher as set forth in claim 12, wherein two or more of the additional conductors are not the same length as the first and second conductors.

14. An electromagnetic projectile launcher as set forth in claim 11, wherein two or more of the additional conductors are not the same length as the first and second conductor.

15. An electromagnetic projectile launcher as set forth in claim 1, wherein the means for propelling the projectile is an arc established between the first and second conductors.

16. An electromagnetic projectile launcher as set forth in claim 11, wherein the means for propelling the projectile is an arc established between the first and second conductors.

17. An electromagnetic projectile launcher as set forth in claim 11, wherein the additional conductors have cooling means cooperatively associated therewith.

18. An electromagnetic projectile launcher comprising:

a projectile;

a high current source;

a plurality of conductors connected to said source and cooperatively arranged to produce a magnetic field directed to increase the force which launches the projectile;

two additional conductors; and circuit breaking means;

said circuit breaking means and said two additional conductors being interconnected with said plurality of conductors so that said two conductors only conduct current after commencement of the launch.

19. An electromagnetic projectile launcher as set forth in claim 18, wherein all of said conductors are generally connected in series prior to completion of the launch.

20. An electromagnetic projectile launcher as set forth in claim 18, wherein all of said conductors are generally connected in a closed loop during the launch.

21. An electromagnetic projectile launcher comprising:

a projectile;

a source of high current comprising inductive energy storage means;

circuit breaking means;

a plurality of conductors generally connected in series with said source;

a pair of additional conductors interconnected with said plurality of conductors and said circuit breaking means so that said pair of additional conductors only conduct projectile propelling current after commencement of the launch, and said plurality of conduction conducting current prior to commencement of the launch and being arranged to produce a magnetic field properly directed to increase the force propelling the projectile during the launch.

22. An electromagnetic projectile launcher as set forth in claim 21, wherein the inductive energy storage is cooperatively provided by an induction coil and inductive energy stored in the magnetic field produced by the plurality of conductors which carry current prior to commencement of the launch.

23. An electromagnetic projectile launcher as set forth in claim 21, wherein the inductive energy storage is substantially the energy stored in the magnetic field produced by the plurality of conductors which conduct current prior to commencement of the launch.

* * * * *